US009643829B2

(12) United States Patent
Ahlstroem

(10) Patent No.: US 9,643,829 B2
(45) Date of Patent: May 9, 2017

(54) KEG CLOSURE WITH SAFETY MECHANISM

(71) Applicant: PETAINER LIDKOEPING AB, Lidkoeping (SE)

(72) Inventor: Karl-Johan Ahlstroem, Skara (SE)

(73) Assignee: Petainer Lidkoeping AB, Lidkoeping (SE)

( * ) Notice: Subject to any disclaimer, the term of this patent is extended or adjusted under 35 U.S.C. 154(b) by 0 days.

(21) Appl. No.: 14/879,236

(22) Filed: Oct. 9, 2015

(65) Prior Publication Data

US 2016/0039654 A1 Feb. 11, 2016

Related U.S. Application Data

(63) Continuation of application No. 13/883,796, filed as application No. PCT/EP2011/069778 on Nov. 9, 2011, now abandoned.

(30) Foreign Application Priority Data

Nov. 9, 2010 (GB) ..... 1018927.2

(51) Int. Cl.
*B67D 1/00* (2006.01)
*B67D 1/08* (2006.01)

(52) U.S. Cl.
CPC ..... *B67D 1/0807* (2013.01); *B67D 1/0804* (2013.01); *B67D 1/0831* (2013.01);
(Continued)

(58) Field of Classification Search
CPC .. B67D 1/0832; B67D 1/0802; B67D 1/0831; B67D 1/125; B67D 1/0838;
(Continued)

(56) References Cited

U.S. PATENT DOCUMENTS 3,195,569 A * 7/1965 Seaquist ..... B65D 83/44 137/553
4,406,301 A * 9/1983 Cerrato ..... B67D 1/0832 137/212

(Continued)

FOREIGN PATENT DOCUMENTS

DE 102007036469 A1 7/2008
WO 03/093163 A1 11/2013

OTHER PUBLICATIONS

Search Report pertaining to Application No. GB1018927.2 filed Nov. 9, 2010.

(Continued)

*Primary Examiner* — Charles P Cheyney
(74) *Attorney, Agent, or Firm* — Dinsmore & Shohl LLP

(57) ABSTRACT

A closure for a keg comprises a housing and at least one valve element that is movable with respect to the housing, inwardly into an open state and outwardly into a closed state. The closure also comprises a lock mechanism having a locking element that is movable with respect to the housing and is capable of holding the valve element in the open state. The lock mechanism includes first and second couplings at which the locking element and the valve element are mutually engageable. The lock mechanism is arranged such that when the locking element and the valve element are engaged at the first coupling, the locking element moves with the valve element as the valve element moves from the open state into the closed state. This movement of the locking element enables engagement between the locking element and the valve element at the second coupling, which engagement at the second coupling occurring on subsequent movement of the valve element into the open state to prevent the valve element returning to the closed state.

15 Claims, 11 Drawing Sheets

(52) U.S. Cl.
CPC ..... *B67D 1/0835* (2013.01); *B67D 1/0845* (2013.01); *B67D 2001/0822* (2013.01)

(58) Field of Classification Search
CPC .. B67D 1/0807; B67D 1/0804; B67D 1/0835; Y10T 137/314; Y10T 137/6137
USPC ..... 222/400.7, 397, 105, 396, 399, 400.8; 137/212, 322, 320; 141/21, 302, 348
See application file for complete search history.

(56) References Cited

U.S. PATENT DOCUMENTS

| | | | | |
|---|---|---|---|---|
| 4,520,954 | A * | 6/1985 | Brown | B67D 1/0832 137/212 |
| 4,739,901 | A | 4/1988 | Dorfman et al. | |
| 4,909,289 | A | 3/1990 | Hagan et al. | |
| 5,242,092 | A * | 9/1993 | Riis | B67D 1/0838 137/322 |
| 5,526,965 | A * | 6/1996 | Degenkolbe | B67D 1/0838 222/400.7 |
| 5,775,541 | A | 7/1998 | Perkins | |
| 6,367,660 | B1 * | 4/2002 | Chang | B67D 1/0838 137/212 |

OTHER PUBLICATIONS

Search Report pertaining to PCT/EP2011/069778 filed Nov. 9, 2011.

* cited by examiner

KEG CLOSURE WITH SAFETY MECHANISM

STATEMENT OF RELATED CASES

This application is a Continuation of U.S. application Ser. No. 13/883,796, filed Jul. 11, 2013 which is a U.S. National Phase Entry based on PCT/EP2011/069778, filed Jul. 11, 2013 which claims priority to GB 1018927.2, filed Nov. 9, 2010.

BACKGROUND OF THE INVENTION

This invention relates to pressurized vessels such as kegs for storing, transporting and dispensing beverages. The invention relates particularly to a closure for a keg, the closure having a safety mechanism to prevent the closure being re-closed after use. This ensures that the keg cannot be left pressurized after use and also that it cannot be refilled with the closure being re-closed afterwards.

Kegs are widely used for the distribution and service of beverages such as beer. A closure in a neck of the keg typically includes a filling and dispensing valve that defines multiple flow paths through the closure. In this way, during filling when the keg is usually inverted, beverage can be injected into the keg through the closure via a first flow path while displaced gas can exit the keg through the closure via a second flow path. Conversely, during dispensing, a propellant gas (typically nitrogen or carbon dioxide) can be injected into the keg through the closure via the first flow path to force beverage out of the keg through the closure along the second flow path. In the most common 'well-type' and 'flat type' arrangements, the closure comprises one or more valve elements and concentric flow paths.

When filling the keg at a filling station on a production line, the keg is usually inverted for use with beer and carbonated soft drinks although it could be upright for other beverages, especially those without effervescence, and a filling head is coupled to the closure to form a seal with the closure. The filling head has one or more formations that press against one or more spring-loaded valve elements of the closure to open the flow paths through the closure. Air inside the keg is flushed out with a relatively inert gas, for example carbon dioxide, and beverage is then injected into the keg via a liquid line connected to the filling head. Gas displaced from the keg by the incoming beverage is forced out through a vent in the filling head. When the keg is removed from the filling station, the filling head is uncoupled from the closure and the one or more valve elements of the closure therefore snap shut under spring loading, sealing the beverage and any remaining inert gas within the keg.

For the purpose of dispensing the beverage, a dispense head is coupled to the closure to form a seal with the closure. The dispense head has a lever that, when depressed, extends one or more plungers corresponding to the formations of the filling head. The plunger(s) therefore press against one or more valve elements of the closure to re-open the flow paths through the closure. Those flow paths communicate with gas and liquid lines connected to the dispense head. A propellant gas is injected into the keg from an external source connected to the gas line. Beverage is then forced out of the keg when a tap in the liquid line is opened to dispense the beverage.

When the dispense head is coupled to the closure, the propellant gas is injected into the keg at super-atmospheric pressure. The keg will remain under super-atmospheric pressure unless and until that gas is vented. It is recommended for safety purposes to vent the propellant gas from the keg when the dispense head is uncoupled from the closure, most commonly when the keg has been emptied and is being interchanged with a fresh, full keg. For this purpose, some dispense heads have a purge valve that is operable to vent propellant gas from the keg before the dispense head is uncoupled from the closure.

However, not all dispense heads have a purge valve and even those that do have a purge valve may not be operated correctly. In practice, a user will often be in a hurry to swap empty kegs for full kegs while dispensing beverages in a busy bar and may not therefore take the time necessary to vent the propellant gas from the empty keg. Instead, the user may simply remove the dispense head from the closure, allowing the spring-loaded valve element(s) of the closure to snap shut and hence to close the flow paths through the closure. The result is that the empty keg remains pressurized, which may not be apparent upon viewing the keg. This is a particular problem where a keg is of flexible material such as blow-moulded polyethylene terephthalate (PET), which is intended to allow the keg to be crushed after use for recycling rather than being returned intact for refilling like a rigid metal keg. Clearly a pressurized keg is not easily crushable. Also, in safety terms, it is undesirable for a pressurized keg to be punctured or ruptured, for example if an attempt is made to crush the keg during waste disposal while believing that the keg is not pressurized.

Another problem is that if the valve element(s) of the closure can still be opened and closed after the original beverage has been dispensed, the keg could possibly be re-filled in an unauthorised manner. For example, the keg could be re-filled with a beverage that is not of the appropriate quality; certainly, the keg is unlikely to be re-filled under the controlled conditions necessary to deliver a beverage in optimum condition. This is particularly undesirable as the keg may bear the brand of the original beverage supplier, whose reputation may be damaged by apparently supplying an inferior product. The keg could even be re-filled with a liquid that is not intended for human consumption and that could be dangerous to drink. Unauthorised refilling may not be apparent from a cursory inspection of the keg.

For these reasons, various keg closures have been proposed in which a valve element can close after filling but cannot close again after dispensing. For example, the proposal disclosed in U.S. Pat. No. 4,909,289 to Hagan et al employs a ratchet arrangement that limits the number of valve openings to allow keg testing and keg filling procedures before the valve element locks open after dispensing.

The proposal in U.S. Pat. No. 4,909,289 is impractical for various reasons. For example, the number of parts in its mechanism, and the way in which those parts interact, leads to long tolerance chains. This renders the mechanism vulnerable to failure where the combined tolerance of the parts causes excessive dimensional fluctuations between different assemblies. Also, the mechanism is not capable of handling the wide variety of filling heads and dispense heads that are available on the market.

A later proposal disclosed in DE 10 2007 036 469 to Schäfer Werke involves depressing a valve element to a lesser extent upon coupling a filling head to the closure for filling (i.e. the filling stroke) and to a greater extent upon coupling a dispense head to the closure for dispensing (i.e. the dispense stroke). The greater movement of the valve element through the dispense stroke causes the valve element to lock in a depressed position such that when the dispense head is removed after dispensing, the valve element cannot move back to the closed position.

The proposal disclosed in DE 10 2007 036 469 requires the filling stroke to be shorter than the dispense stroke. However, the use of a well-type or flat-type fitting involves a filling stroke that is often equal to or sometimes longer than the dispense stroke. The proposal in DE 10 2007 036 469 cannot handle situations where the filling stroke is longer than or equal to the dispense stroke because the valve element will either lock open prematurely during the filling procedure or will fail to lock open after the dispensing procedure.

It is against this background that the present invention has been devised.

The invention resides in a closure for a pressure vessel such as a keg, the closure comprising: at least one valve element that is movable with respect to the housing, inwardly into an open state and outwardly into a closed state; and a lock mechanism having a locking element that is movable with respect to the housing and is capable of holding the valve element in the open state; wherein the lock mechanism includes first and second couplings at which the locking element and the valve element are mutually engageable, and is arranged such that when the locking element and the valve element are engaged at the first coupling, the locking element moves with the valve element as the valve element moves from the open state into the closed state, said movement of the locking element enabling engagement between the locking element and the valve element at the second coupling, which engagement at the second coupling occurs on subsequent movement of the valve element into the open state to prevent the valve element returning to the closed state.

The lock mechanism employed by the invention does not suffer from the long tolerance chains of U.S. Pat. No. 4,909,289 or the inability of U.S. Pat. No. 4,909,289 to handle the variety of filling heads and dispense heads that are on the market. Also, unlike DE 10 2007 036 469, the mechanism of the invention can be used even if the filling stroke is equal to or longer than the dispense stroke.

In the preferred embodiment of the invention to be described below, the first coupling is disposed outwardly with respect to the second coupling.

Preferably, the couplings are defined by ratchet formations acting between the locking element and the valve element for substantially unidirectional outward movement of the locking element with respect to the housing. Advantageously, the ratchet formations provide reliable movement between the locking element and the valve element.

Preferably, the valve element is movable with respect to the housing along an axis, the locking element is movable axially with respect to the housing in response to said axial movement of the valve element, and the couplings comprise axially-spaced engaging formations acting between the locking element and the valve element. Advantageously, axial movement simplifies and so improves the reliability of the closure.

Preferably, following engagement between the locking element and the valve element at the first coupling, outward movement of the valve element moves the locking element to a position within the housing in which further outward movement of the locking element with respect to the housing is limited in extent.

Preferably, following engagement between the locking element and the valve element at the second coupling, further outward movement of the locking element is limited by encountering a stop formation fixed relative to the housing.

Preferably, following engagement between the locking element and the valve element at the first coupling, outward movement of the valve element moves the locking element to a position within the housing in which inward movement of the locking element with respect to the housing is limited in extent.

Preferably, upon moving outwardly with the valve element, the locking element passes a ratchet formation that restrains inward movement of the locking element. The ratchet formation may be a shoulder fixed relative to the housing.

Preferably, the locking element comprises an opposed formation arranged to engage with the ratchet formation.

Preferably, following movement of the valve element from the open state into the closed state, the locking element lies between opposed limit formations disposed respectively outward of an outer end and inward of an inner end of the locking element.

Preferably, the limit formations comprise the stop formation and the ratchet formation.

Preferably, the couplings comprise resilient snap-fit formations engageable by relative sliding movement of the valve element with respect to the locking element.

Preferably, the couplings comprise first and second coupling components on the locking element that are engageable successively by a coupling component on the valve element upon successive opening strokes of the valve element.

Of course, the inventive concept extends to a pressure vessel such as a keg, supplied with or fitted with the closure of the invention.

BRIEF DESCRIPTION OF THE DRAWINGS

In order that the invention may be more readily understood, reference will now be made, by way of example, to the accompanying drawings in which.

Figure 1:
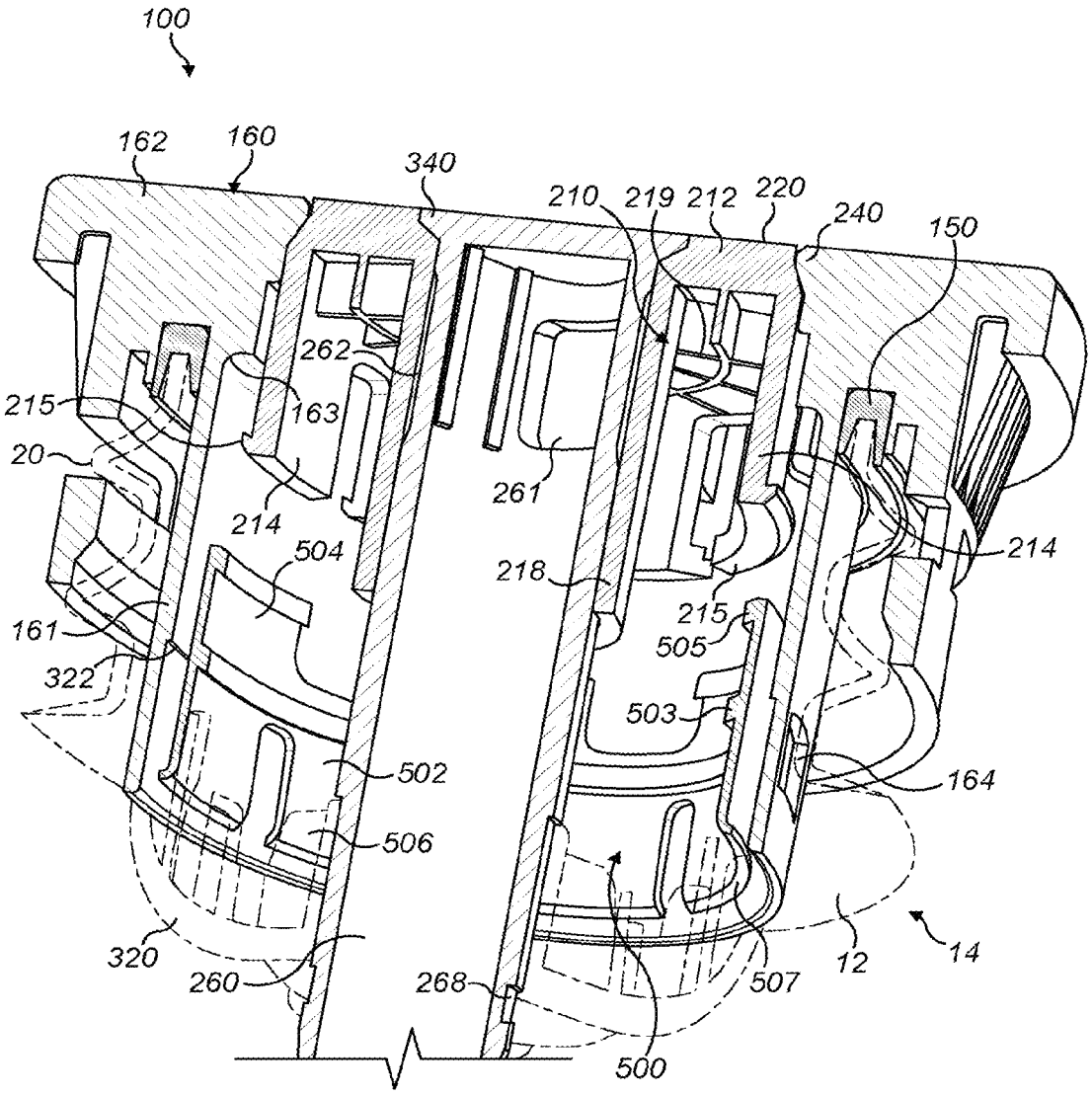
FIG. 1 is a sectional side view through a closure according to a first embodiment of the present invention, fitted in the neck of a plastics keg, showing the closure before filling with the valve element closed.

The first and second embodiments of the present invention relate to a keg closure functionally and in key dimensions with existing keg closures known in the art as 'Flat Type', 'Type A' or 'Flat Type A' keg closures. As such, dispensing or filling heads suitable for use with such 'Flat Type A' keg closures can also be used in conjunction with the closure of the first and second embodiments of the present invention.

DETAILED DESCRIPTION OF THE PREFERRED EMBODIMENTS

FIGS. 1 to 5 relate to the first embodiment of the present invention and FIGS. 6 to 11 of the drawings relate to the second embodiment of the present invention. The same reference numerals are used to refer to similar features in the first and second embodiments.

In FIGS. 1 to 10, sectional views are shown of the closures 100. The sections of the closures 100 are taken in an axial direction, with the section plane containing a central longitudinal axis of the neck 12 of a plastics keg 14 onto which each closure 100 is fitted. It will be understood that each closure 100 is substantially symmetrical about the section plane and so features on one side of the section plane are present on the other side of the section plane.

The components of each closure 100 are made predominantly of injection-moulded plastics materials such as polyester, polyolefin, polyamide or the like, except where stated otherwise below. It is emphasised that the materials used for the keg 14 and the closure 100 and their methods of manufacture are merely preferred and are not essential to the broad inventive concept.

A closure 100 according to the first embodiment of the present invention will now be described in more detail with reference to FIGS. 1 to 5.

The closure 100 has a generally annular housing 160, an inner tail portion 161 of which is shaped to fit closely within the tubular neck 12 of a plastics keg 14.

An outer head portion 162 of the closure 100 retains the housing 160 on the keg 14 by resiliently engaging circumferential ridges 20 projecting laterally from the exterior of the neck 12. An annular groove on the housing 160 defined between the inner tail portion 161 and the outer head portion 162 receives an annular seal 150 that is compressed against the upper end of the neck 12 to seal the housing 160 to the keg 14 when the housing 160 is snap-fitted onto the neck 12.

The housing 160 surrounds a valve element 210 that is displaceable against spring bias axially inwardly toward the interior of the keg 14 to open concentric flow paths extending through the closure 100 and into the keg 14.

Hereinafter, where contextually appropriate, the terms 'upper', 'upward' or the like should be understood to mean relating to a position or direction that is axially outward, away from the interior of the keg 14 to which the closure 100 is fitted. Similarly, the terms 'lower', 'downward' or the like relate to positions or directions that are axially inward, towards the interior of the keg 14. The reader will appreciate that references to 'upper' and 'lower' relate to the general orientation of the closures shown in the drawings, although that orientation may not necessarily be maintained in use. Furthermore, references pertaining to an axis should be understood to be in respect of the central longitudinal axis of the neck 12 of the keg 14 to which the closure 100 is fitted.

The valve element 210 surrounds, can move axially along, and is supported for sliding movement by a tubular spear connector 260. The spear connector 260 is fixed relative to the housing 160 via a lock ring 320. A lower portion of the lock ring 320 engages with complementary engagement formations 268 on the exterior of the spear connector 260. An upper portion of the lock ring 320 is received within the lower section of the tail portion 161, engaging with openings 164 in the tail portion 161 to enable the lock ring 320 to be snap-fitted to the housing 160. The upper portion of the lock ring 320 is generally annular in shape, and so defines a cylindrical space within it. The upper end of the lock ring 320 forms an upwardly facing annular ledge 322 extending radially inwardly from the inner wall of the tail portion 161.

The housing 160 comprises an annular shoulder 163 formed at the upper end of the tail portion 161 that faces downward towards the annular ledge 322. The annular shoulder 163 is defined by the inner facing surface of the tail portion 161 curving radially inward towards the central longitudinal axis of the keg neck 12.

A tube (not shown) communicates with the hollow interior of the spear connector 260 and extends into the base of the keg 14 from the inner end of the spear connector 260. The tube is typically of extruded plastics material such as polyethylene.

The valve element 210 comprises a generally annular head 212 at its upper end. The valve element 210 also comprises a skirt 214 depending downwardly from the radially-outer edge of the annular head 212 and a tubular stem 218 depending downwardly from the radially-inner edge of the annular head 212. Elongate channels are cut into the skirt 214 to define a plurality of downwardly depending flaps 214.

The valve element 210 comprises webs 219 bridging the region between the annular head 212, stem 218 and flaps 214.

A resilient annular seal 220 is defined at the upper end of the annular head 212 of the valve element 210. The upper radially-outer edge of the annular seal 220 seals against a frusto-conical outer valve seat 240 facing radially inwardly from the housing 160. An upper, radially-inner edge of the annular seal 220 seals against a frusto-conical inner valve seat 340 defined by a flared upper end of the spear connector 260. The inner valve seat 340 faces radially outwards.

A coil spring (not shown) surrounds the stem 218 of the valve element 210 and biases the valve element 210 upward, urging the annular seal 220 into sealing contact with the inner valve seat 340 and outer valve seat 240. An upper end of the coil spring bears against the webs 219 of the valve element 210 and a lower end of the coil spring bears against the lock ring 320.

The valve element 210 surrounds the spear connector 260 and can move down along the outer surface of the spear connector 260 against the spring bias.

The diameter of the outer surface of the spear connector 260 is reduced adjacent the flared upper end of the spear connector 260 to form a band-shaped indent 262 encircling the spear connector 260. An opening 261 penetrates the wall of the spear connector 260 communicating with the indent 262.

Figure 3:
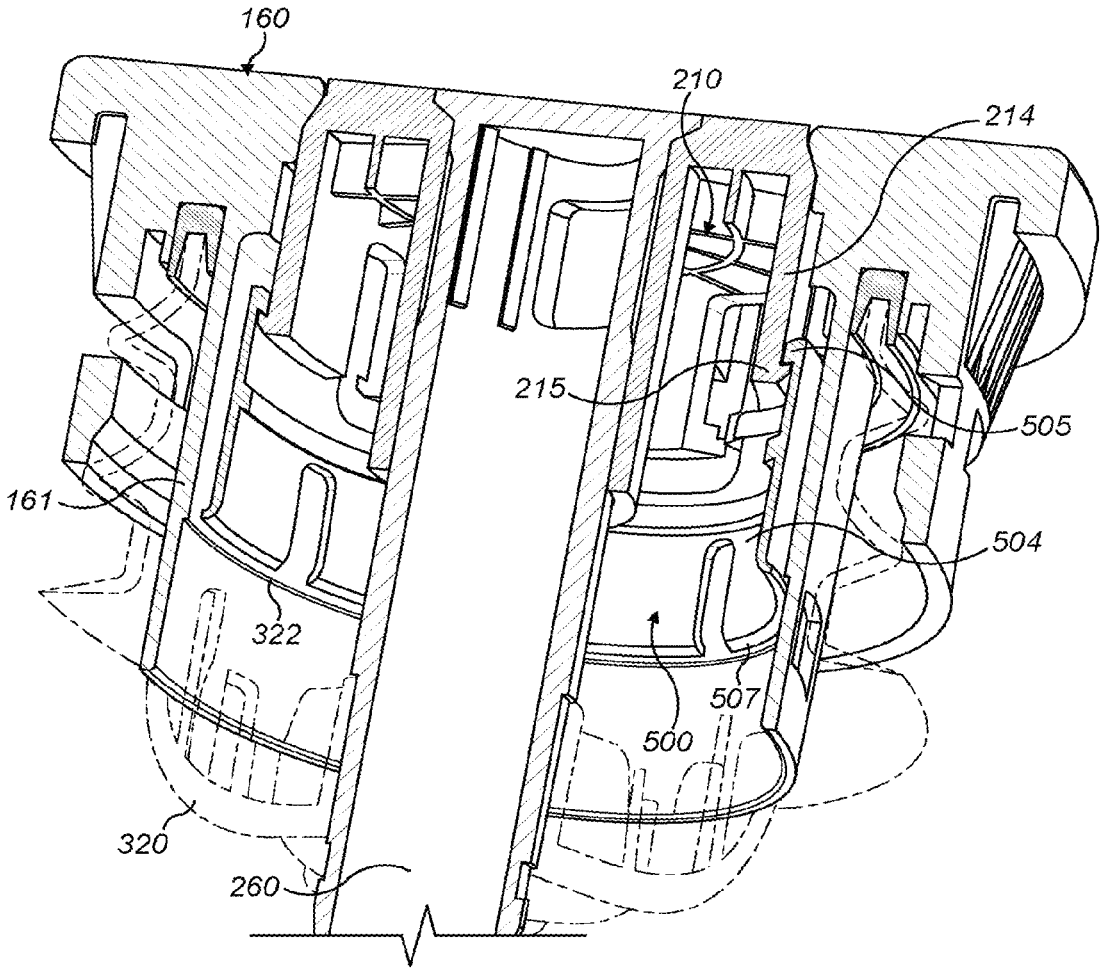
FIG. 3 corresponds to FIGS. 1 and 2 but shows the closure after filling when the filling head has been uncoupled from the closure, with the valve element again closed.

Referring to FIGS. 1 and 3, the indent 262 is completely surrounded by the valve element 210 when the valve element 210 is outwardly biased into sealing contact with the inner and outer valve seats 340, 240. In these configurations of the closure 100, the flow paths into the keg 14 are closed.

Figure 2:
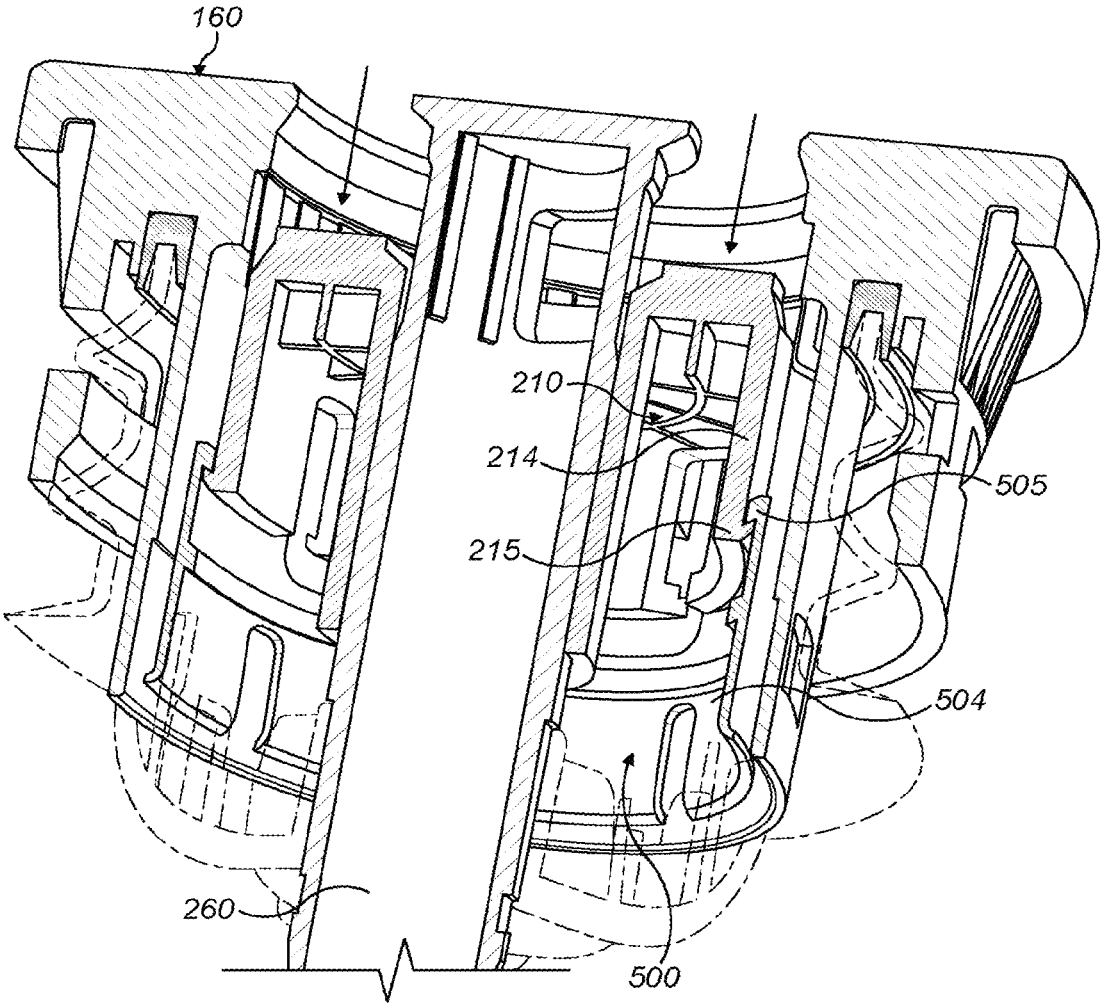
FIG. 2 corresponds to FIG. 1 but shows the closure during filling when a filling head has been coupled to the closure, with the valve element open.
Figure 4:
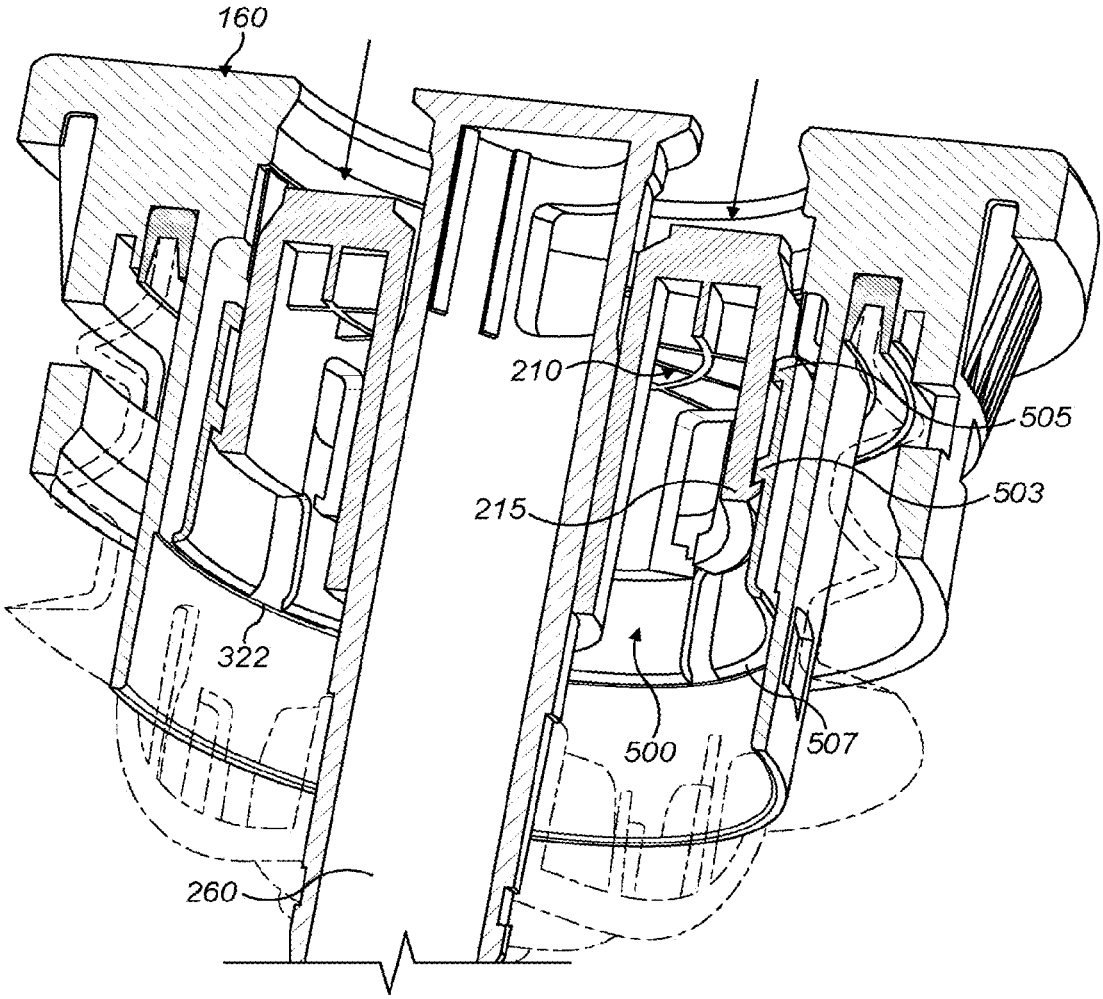
FIG. 4 corresponds to FIGS. 1 to 3 but shows the closure during dispensing when a dispense head has been coupled to the closure, with the valve element again open.

A filling head and a dispense head for use with the closure 100 of the present embodiment are conventional and so are omitted from the drawings. However the forces they apply to the valve element 210 of the closure 100, and their resulting effect on the valve element 210, is represented by the arrows in FIGS. 2 and 4 of the drawings. FIGS. 2 and 4 show the closure 100 with the valve element 210 open. When a filling head is coupled to the closure 100 as represented by the arrows in FIG. 2, an annular plunger on the filling head presses down on the annular seal 220 and so depresses the valve element 210, down towards the interior of the keg 14.

Similarly when a dispense head is coupled to the closure 100 as represented by the arrows in FIG. 4, an annular plunger on the dispense head also presses down on the annular seal 220, depressing the valve element 210, down toward the interior of the keg 14.

When the valve element 210 is pushed down as shown in FIGS. 2 and 4, the valve element 210 moves away from the inner and outer valve seats 340, 240 to permit fluid flow along two flow paths around the valve element 210.

An inner flow path runs from the inside of the annular plunger of the filling or dispense head (i.e. between the arrows) around the flared upper end of the spear connector 260, into the indent 262 and opening 261 and so down into the bottom of the keg 14 via the hollow interior of the spear connector 260 and tube connected to the spear connector 260. An outer flow path runs from the outside of the annular plunger (i.e. outside of the arrows) between the tail portion 161 of the housing 160 and valve element 210, via openings in the lock ring 320 and into the neck 12 of the keg 14.

In practice, beverage will flow into the keg 14 along the outer flow path during filling in FIG. 2 and from the keg 14 along the inner flow path during dispensing in FIG. 4. Conversely, gas will flow from the keg 14 along the inner flow path during filling in FIG. 2 and into the keg 14 along the outer flow path during dispensing in FIG. 4. The beverage and gas flows specified during filling assume that the keg 14 is inverted during filling, which is conventional for effervescent drinks such as beer. However it is also possible to fill the keg 14 with suitable beverages when upright, in which case beverage will flow into the keg 14 along the inner flow path and gas will flow from the keg 14 along the outer flow path.

In general terms, the above features of the closure 100 are largely conventional. The invention resides in a lock mechanism that includes couplings that act between the valve element 210 and a latch element 500 that is initially disposed axially inwardly of the valve element 210, toward the interior of the keg 14.

In the present embodiment, the couplings are defined by catch formations 215 on the valve element 210 and latch formations 503, 505 on the latch element 500 as will be described in great detail below.

Catch formations 215 are integrally-moulded at the lower end of each flap 214 of the valve element 210. The catch formations 215 face radially outward and on their lower end define a downwardly and radially-outwardly facing ramp. On their upper side, the catch formations 215 define a hook. These catch formations 215 are arranged to interact with complementary latch formations 503, 505 on the latch element 500 as will be described.

The latch element 500 is substantially tubular and comprises an annular body 502, a set of fingers 504 and a plurality of legs 506. The fingers 504 and legs 506 extend respectively upwards and downwards at the upper and lower ends of the annular body 502 and are circumferentially curved to match the curvature of the annular body 502. Latch formations 503, 505 are integrally-moulded with the latch element 500 and are complementary in shape and function to the catch formations 215 of the valve element 210.

A first set of latch formations 505 are disposed circumferentially about the upper tips of the fingers 504. A second set of latch formations 503 are disposed below the first set, circumferentially about the interior of the annular body 502, in the region where the legs 506 extend from the annular body 502. Each of the first and second set of latch formations 505, 503 face radially inward. On their upper sides each of the first and second set of latch formations 505, 503 define an upwardly and radially-inwardly facing ramp. On their lower end they each define a hook.

Feet 507 are disposed about the lower end of the legs 506. The feet 506 face radially outward and stand proud of the general outer diameter of the latch element 500.

The interaction between the valve element 210, the latch element 500 and other components of the closure 100 will now be described.

FIG. 1 shows the closure 100 before filling, where the valve element 210 is closed, biased upward by the aforementioned coil spring. The latch element 500 is at its lowermost position within the tail portion 161 of the housing 160. The lower part of the latch element 500 is received within the cylindrical space defined by the upper portion of the lock ring 320. The feet 507 bear against the inside surface of the upper portion of the lock ring 320 causing the legs 506 to deflect radially-inwardly.

At the upper part of the latch element 500, the fingers 504 extend upwards toward the flaps 214 in mutual angular alignment. The fingers 504 and flaps 214 are axially spaced from one another and so do not yet make contact with one another.

FIG. 2 shows the closure during filling when a filling head has been coupled to the closure with the valve element open.

Comparing FIG. 1 with FIG. 2, as the valve element 210 is driven downward into the keg 14 for the first time the complementarily-ramped surfaces on the catch formations 215 and first set of latch formations 505 allow them to slide over one another until they snap over one another.

After the first downward movement of the valve element 210 to the position shown in FIG. 2, the valve element 210 can then be allowed to rise again under the biasing action of the coil spring to the position shown in FIG. 3. Thus, after the first stroke that opens the flow paths for filling the keg 14 with beverage, the flow paths can be re-closed again for the storage and/or transportation of the keg 14. In particular, the valve element 210 is able to rise again under the biasing action of the coil spring to re-close the flow paths into the keg 14. In doing so, the hook parts of the catch formations 215 engage with the hook parts of the first set of latch formations 505 thereby carrying the latch element 500 upwardly with the valve element 210.

During movement from the configuration shown in FIG. 2 to that of FIG. 3, the latch element 500 moves upwardly and slides clear of the lock ring 320. In the process of doing so, the feet 507 snap over the annular ledge 322 formed by the upper end of the lock ring 320. As will be described below, the feet 507 and the ledge 322 together now prevent downward movement of the latch element 500 into its original position.

FIG. 3 shows the latch element 500 and the valve element 210 hooked together having come to the end of their upward movement after the valve elements 210 first downward and upward stroke of the valve element 210. As mentioned, the flow paths have re-closed, and the keg closure 100 can be stored and transported without spillage or spoiling of a beverage within the keg 14.

Once the keg 14 is filled, the closure 10 is preferably covered with means for dust protection and tamper evidence, such as a foil cap (not shown). The filled keg 14 may then be stored and delivered to customers for dispensing as required. To facilitate transportation, a handle (not shown) may be attached to the neck 12 of the keg 14.

FIG. 4 shows the configuration of the closure 100 during dispensing, when a dispense head has been coupled to the closure 100. In this configuration, the valve element 210 is moved down to re-open the flow paths into the keg 14.

During movement from the configurations shown in FIG. 3 to that of FIG. 4, the valve element 210 is depressed against the bias of the coil spring, and slides down into the keg 14. In doing so, the catch formations 215 unhook themselves from the first set of latch formations 505 of the latch element 500 and slide down towards the second set of latch formations 503. As mentioned, downward movement due to force transmitted to the latch element 500 from the valve element 210 is restrained by the feet 507 abutting against the annular ledge 322.

As the valve element 210 approaches the end of its downward travel, the catch formations 215 slide over the second set of latch formations 503 of the latch element 500 and snap over them, in the same way as described above in relation to the first set of latch formations 505.

Figure 5:
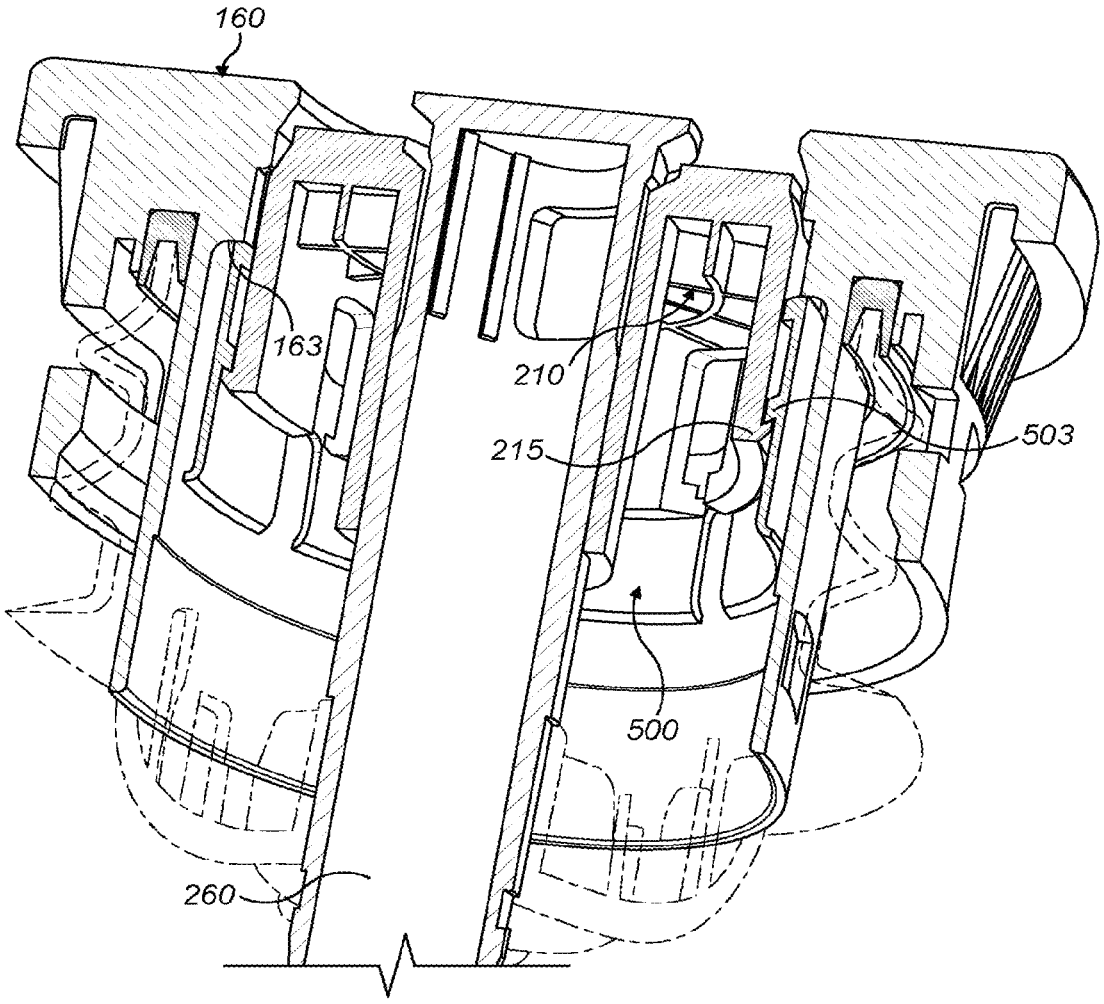
FIG. 5 corresponds to FIGS. 1 to 4 but shows the closure after dispensing when the dispense head has been uncoupled from the closure, with the valve element now permanently open.

When the valve element 210 is released again after dispensing, as shown in FIG. 5, the upward travel of the valve element 210 is limited to an extent that the flow paths can no longer close. This is because the upper edge of the latch element 500, onto which the valve element 210 is hooked, has engaged with the annular shoulder 163 of the housing 160. In particular, the engagement of the catch formations 215 with the second set of latch formations 503 draws the latch element 500 up with the valve element 210 to bring the upper edge of the latch element 500 into contact with the annular shoulder 163. The latch element 500 thus restrains axial movement of the valve element 210 against the annular shoulder 163.

A second embodiment of the present invention will now be described. In the interests of clarity and brevity, mainly the differences between the first and second embodiments will be described. Unless specified to the contrary, features present in the first embodiment should be assumed to be present in the second embodiment where context allows. The same reference numerals will be used for like features.

In this second embodiment, catch formations 215 of the valve element 210 are provided on the tubular stem 218. The catch formations 215 are disposed on the lower end of the tubular stem 218, on its radially-inward facing surface. The catch formations 215 interact with the latch element 500 to control the position of the valve element 210 as will be described.

The latch element 500 surrounds and is supported for sliding movement by the spear connector 260 rather than being supported by the housing 160 as in the first embodiment.

The latch element 500 is generally annular in shape, its radially-inward surface sliding along the radially-outward surface of the spear connector 260.

The radially-outward surface of the spear connector 260 is substantially cylindrical and defines a circumferential groove 264 disposed axially below an opening 261 and band-shaped indent 262 towards the upper end of the spear connector 260. The circumferential groove 264 includes a downward-facing annular shoulder 263 and an upward-facing ring-shaped ledge 265 that face toward one another.

Figure 6:
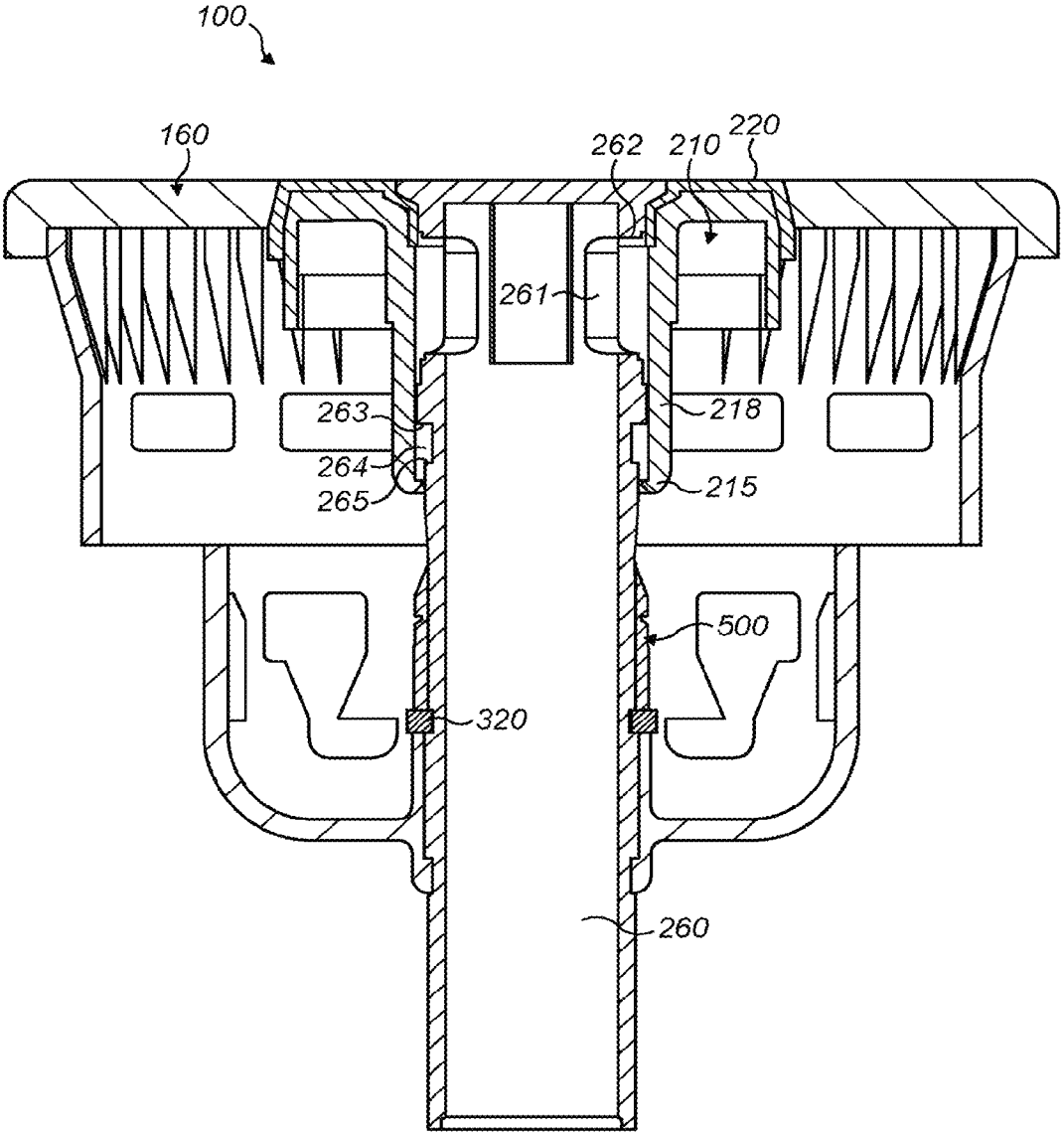
FIG. 6 is a sectional side view through a closure according to a second embodiment of the present invention, fitted in the neck of a plastics keg, showing the closure before filling with the valve element closed.
Figure 11:
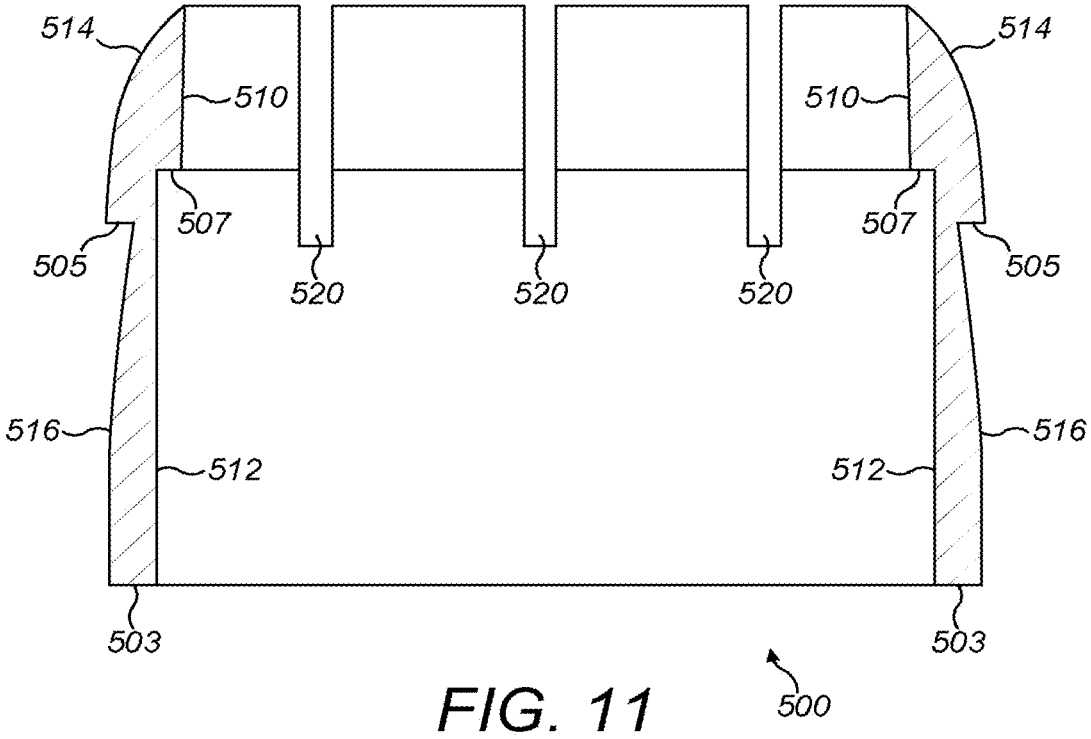
FIG. 11 is a schematic sectional view of a latch element of the closure of FIGS. 6 to 10.

FIG. 11 is a schematic sectional view of the latch element 500 of the closure of FIG. 6. The latch element 500 is shown in isolation to the other components of the closure 100. It will be noted that the features of the latch element 500 are exaggerated in FIG. 11 to aid the understanding of the features of the latch element 500.

The radially-inward surface of the latch element 500 is divided into two sections, an upper inner-facing section 510 and a lower inner-facing section 512, each being substantially parallel to the central longitudinal axis of the keg neck 12 and one another, the upper inner-facing section 510 having a smaller diameter than the lower inner-facing section 512. An annular downward-facing lip 507 separates the upper and lower inner-facing sections 510, 512.

The radially-outward surface of the latch element 500 is also divided into two sections, an upper outer-facing section 514 and an lower outer-facing section 516, both sloping relative to the central longitudinal axis of the keg neck 12 to define ramps that face both upward and radially outwards.

The upper outer-facing section 514 slopes to meet the upper inner-facing section 510 at the upper end of the latch element 500. The lower edge of the ramp defined by the upper outer-facing section 514 has a diameter greater than that of the upper edge of the ramp defined by the lower outer facing section 516. A downward facing overhang 505 is thus defined and separates the upper and lower outer-facing sections 514, 516.

An annular downward facing edge 503, at the lowermost end of the latch element 500, separates the lower inner-facing section 516 and the lower outer-facing section 512.

Slots 520 are defined at intervals circumferentially about the upper-end of the latch element 500 interrupting its generally annular shape, thereby defining fingers at the upper end of the latch element 500.

As will be described in greater detail below, the overhang 505 and the edge 503 of this second embodiment are respectively functionally equivalent to the first and second latch formations 505, 503 described in relation to the first embodiment of the present invention. Similarly, the lip 507 serves a similar function to the feet 507 of the first embodiment.

Referring back to FIG. 6, the closure 100 is shown before filling, where the valve element 210 is closed, biased axially upward. The latch element 500 is at its lowermost position, surrounding and supported by the cylindrical outer surface of the spear connector 260. The fingers of the latch element 500 flex by virtue of contact between the upper inner-facing section 510 with the spear connector 260, and so exert a radially inward biasing force against it.

Figure 7:
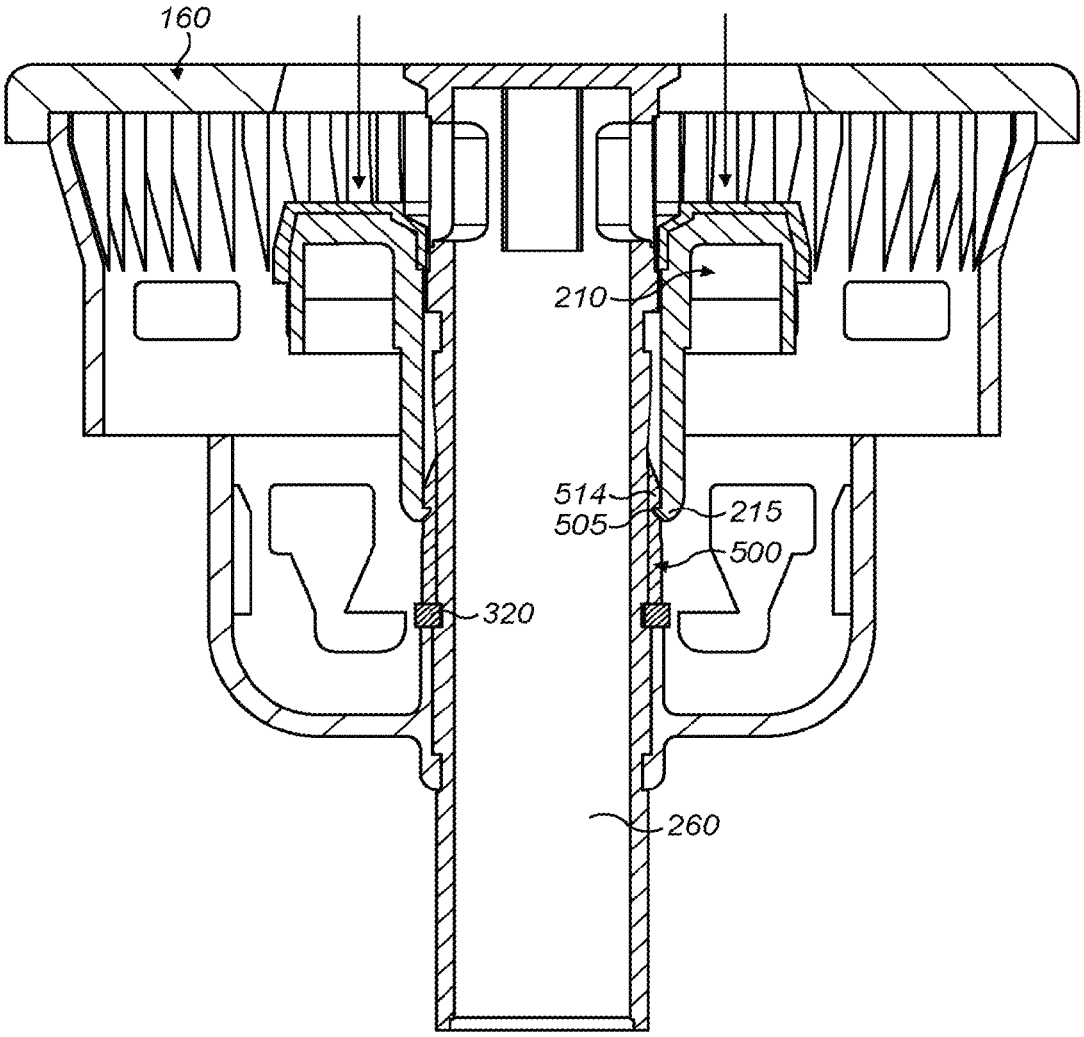
FIG. 7 corresponds to FIG. 6 but shows the closure during filling when a filling head has been coupled to the closure, with the valve element open.

Referring to FIG. 7, as the valve element 210 is driven downward into the keg 14 for the first time, the catch formations 215 slide over the ramp of the upper outer-facing section 514 until the catch formations 215 snap over the overhang 505.

Figure 8:
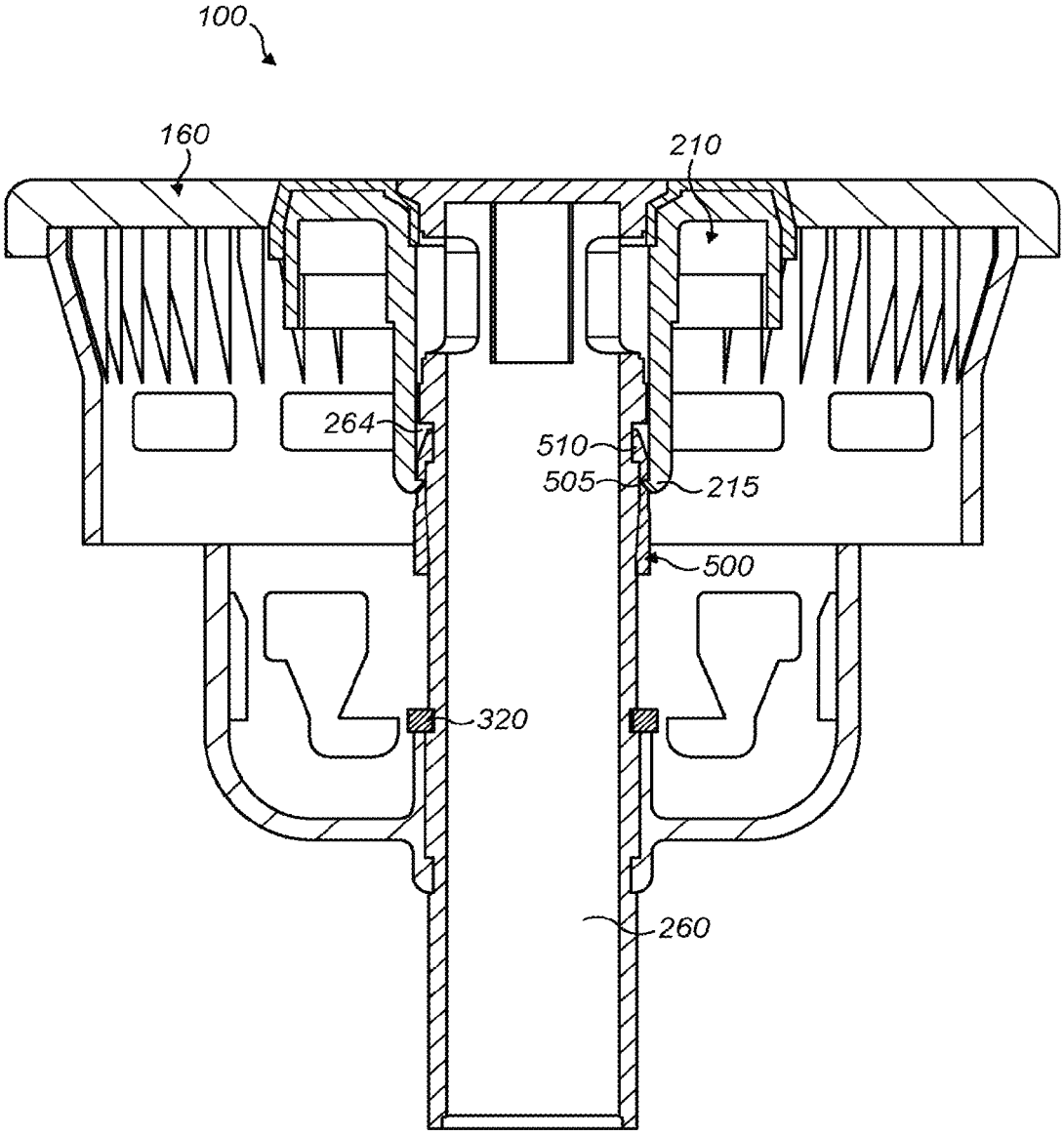
FIG. 8 corresponds to FIGS. 6 and 7 but shows the closure after filling when the filling head has been uncoupled from the closure, with the valve element again closed.

After this first axially downward movement of the valve element 210 to the position shown in FIG. 7, the valve element 210 can then be allowed to rise again under the biasing action of the coil spring to the position shown in FIG. 8. Thus, after the first stroke used to open the flow paths for filling the keg 14 with beverage, the flow paths can be re-closed again for the storage and/or transportation of the keg 14.

In particular, the valve element 210 is able to rise again under the biasing action of the coil spring to re-close the flow paths into the keg 14. In doing so, the catch formations 215 of the valve element 210 and the overhang 505 of the latch element 500 hook into one another thereby carrying the latch element 500 up with the valve element 210.

The latch element 500 slides axially upward outwardly away from the interior of the keg 14. In the process of doing so, the upper inner-facing section 510 which was previously biased radially-inward against the spear connector 260 is guided up it to snaps into the circumferential groove 264 defined by the spear connector 260.

FIG. 8 shows the latch element 500 and the valve element 210 latched together having come to the end of their upward movement after the first downward stroke of the valve element 210. As mentioned, the flow paths have re-closed, and the keg closure 100 can be stored and transported without spillage or spoiling of a beverage within the keg 14.

Figure 9:
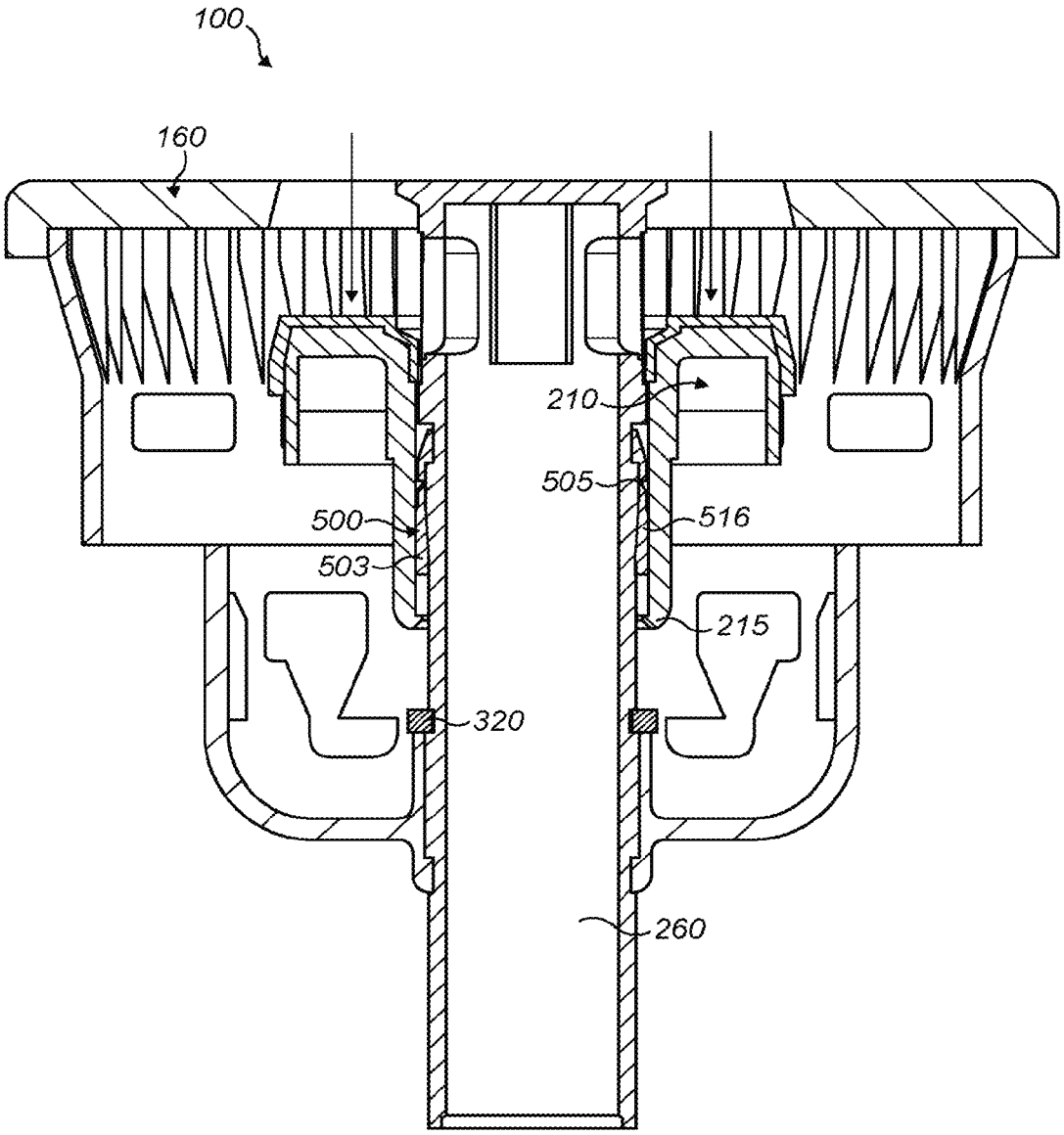
FIG. 9 corresponds to FIGS. 6 to 8 but shows the closure during dispensing when a dispense head has been coupled to the closure, with the valve element again open.

FIG. 9 shows the configuration of the closure 100 during dispensing, when a dispense head has been coupled to the closure 100. In this configuration, the valve element 210 has once again moved down to re-open the flow paths into the keg 14.

During movement from the configuration shown in FIG. 8 to that of FIG. 9, the valve element 210 is depressed against the bias of the coil spring, and slides down into the keg 14. In doing so, the catch formations 215 unhook away from the overhang 505 of the latch element 500 and slide down along the ramp of the lower outer-facing section 516 towards the annular edge 503 of the latch element 500.

The latch element 500 is restrained against movement back down in towards the keg 14 by virtue of the lip 507 abutting against the ring-shaped ledge 265 of the circumferential groove 264.

As the valve element 210 approaches the end of its travel downwardly in towards the interior of the keg 14, the catch formations 215 slide over and beyond the lower end of the latch element 500 snapping over the annular edge 503.

Figure 10:
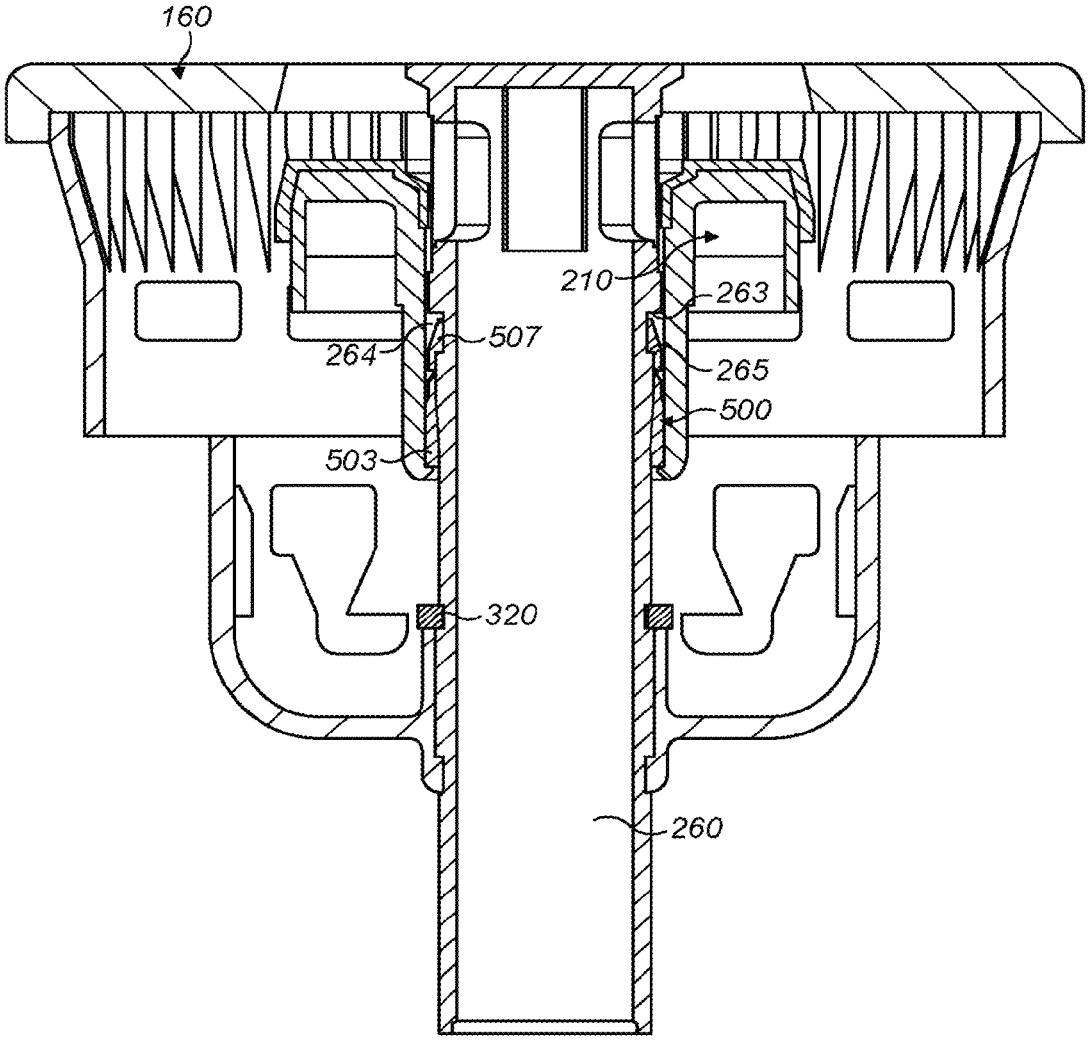
FIG. 10 corresponds to FIGS. 6 to 9 but shows the closure after dispensing when the dispense head has been uncoupled from the closure, with the valve element now permanently open.

When the valve element 210 is released again after dispensing, as shown in FIG. 10, the upward travel of the valve element 210 is restricted to an extent that the flow paths can no longer close. This is because the axially upper edge of the latch element 500, onto which the valve element 210 is hooked, has engaged with the annular shoulder 263 of the circumferential groove 264 of the spear connector 260.

In particular, the engagement of the catch formations 215 with the annular axially-downward facing edge 503 of the latch element 500 restrains further upward movement of the valve element 210.

In this way, the mechanisms of the first and second embodiments of the present invention ensure that the keg cannot be left pressurized after use and also that it cannot be refilled with the closure being re-closed afterwards. As noted above, these mechanisms do not suffer from the long tolerance chains of U.S. Pat. No. 4,909,289 or the inability of U.S. Pat. No. 4,909,289 to handle the variety of filling heads and dispense heads that are on the market. Also, unlike DE 10 2007 036 469, the mechanisms of the invention can be used even if the filling stroke is equal to or longer than the dispense stroke.

What is claimed is:

1. A closure for a pressure vessel, the closure comprising:

a housing;

at least one valve element that is movable with respect to the housing, inwardly into an open state and outwardly into a closed state; and a lock mechanism having a locking element that is movable with respect to the housing and is capable of holding the valve element in the open state, the locking element having an outer end and an inner end;

wherein the lock mechanism includes first and second couplings at which the locking element and the valve element are mutually engageable, and is arranged such that when the locking element and the valve element are engaged at the first coupling, the locking element moves outwardly together with the valve element as the valve element moves from the open state into the closed state, said movement of the locking element enabling engagement between the locking element and the valve element at the second coupling, which engagement at the second coupling occurs on subsequent movement of the valve element into the open state to prevent the valve element returning to the closed state.

2. The closure of claim 1, wherein the first coupling is disposed outwardly with respect to the second coupling.

3. The closure of claim 1, wherein the first and second couplings are defined by ratchet formations acting between the locking element and the valve element for substantially unidirectional outward movement of the locking element with respect to the housing.

4. The closure of claim 1, wherein the valve element is movable with respect to the housing along an axis, the locking element is movable axially with respect to the housing in response to said axial movement of the valve element, and the first and second couplings comprise axially-spaced engaging formations acting between the locking element and the valve element.

5. The closure of claim 1, wherein following engagement between the locking element and the valve element at the first coupling, outward movement of the valve element moves the locking element to a position within the housing in which further outward movement of the locking element with respect to the housing is limited in extent.

6. The closure of claim 5, wherein following engagement between the locking element and the valve element at the second coupling, further outward movement of the locking element is limited by encountering a stop formation fixed relative to the housing.

7. The closure of claim 1, wherein following engagement between the locking element and the valve element at the first coupling, outward movement of the valve element moves the locking element to a position within the housing in which inward movement of the locking element with respect to the housing is limited in extent.

8. The closure of claim 7, wherein upon moving outwardly with the valve element, the locking element passes a ratchet formation that restrains inward movement of the locking element.

9. The closure of claim 8, wherein said ratchet formation is a shoulder fixed relative to the housing.

10. The closure of claim 8, wherein the locking element comprises an opposed formation arranged to engage with the ratchet formation.

11. The closure of claim 1, wherein following movement of the valve element from the open state into the closed state, the locking element lies between opposed limit formations disposed respectively outward of the outer end and inward of the inner end of the locking element.

12. The closure of claim 11, wherein the limit formations comprise a stop formation and a ratchet formation.

13. The closure of claim 1, wherein the first and second couplings comprise resilient snap-fit formations engageable by relative sliding movement of the valve element with respect to the locking element.

14. The closure of claim 1, wherein the first and second couplings comprise first and second coupling components on the locking element that are engageable successively by a coupling component on the valve element upon successive opening strokes of the valve element.

15. A keg supplied with or fitted with the closure of claim 1.

* * * * *